United States Patent [19]

Haneda et al.

[11] Patent Number: 4,951,585

[45] Date of Patent: Aug. 28, 1990

[54] APPARATUS FOR FOLDING A STRIP OF MATERIAL AND SUPPLYING THE SAME TO A SEWING MACHINE

[75] Inventors: Kunio Haneda, Okazaki; Hideo Kawaguchi, Inazawa, both of Japan

[73] Assignee: Brother Kogyo Kabushiki Kaisha, Japan

[21] Appl. No.: 341,476

[22] Filed: Apr. 21, 1989

[30] Foreign Application Priority Data

Apr. 28, 1988 [JP] Japan ..... 63-57621[U]

[51] Int. Cl.[5] ..... D05B 35/06

[52] U.S. Cl. ..... 112/121.27; 112/104; 112/130; 112/147

[58] Field of Search ..... 112/121.27, 121.26, 112/104, 152, 130, 147, 262.3, 265.1

[56] References Cited

U.S. PATENT DOCUMENTS

| | | | |
|---|---|---|---|
| 3,094,084 | 6/1963 | Hedegaard | 112/104 |
| 3,111,920 | 11/1963 | Hedegaard | 112/104 |
| 3,699,907 | 10/1972 | Anderson et al. | 112/121.27 |
| 3,763,800 | 10/1973 | Rockerath | 112/121.11 X |
| 4,114,544 | 9/1978 | Miyachi et al. | 112/104 |
| 4,287,842 | 9/1981 | Breck, Jr. | 112/121.27 |
| 4,385,571 | 5/1983 | Breck, Jr. | 112/121.27 |
| 4,389,957 | 6/1983 | Block et al. | 112/262.3 |
| 4,502,399 | 3/1985 | Seaman | 112/121.27 |
| 4,527,491 | 7/1985 | Block et al. | 112/104 |
| 4,561,365 | 12/1985 | Schmidt et al. | 112/121.27 |
| 4,561,366 | 12/1985 | Schmidt et al. | 112/121.27 |
| 4,632,047 | 12/1986 | Seaman | 112/121.27 |
| 4,787,325 | 11/1988 | Black et al. | 112/262.3 X |
| 4,803,935 | 2/1989 | Joseph | 112/121.27 |
| 4,859,260 | 8/1989 | Tice | 112/104 X |

*Primary Examiner*—Peter Nerbun
*Attorney, Agent, or Firm*—Oliff & Berridge

[57] ABSTRACT

An apparatus for folding a strip of material and supplying the same to a sewing machine which sewingly attach the folded strip of material (B) to a base material (C). The apparatus comprises a movable base (78) reciprocally movable between its standby position and its supply position, a strip of a material support member (87,88) mounted on the movable base (78) for receiving and supporting the strip of material (B) supplied when the movable base (78) is positioned at the standby position, and for transferring the strip of material (B) to the sewing machine bed (121) when the movable base (78) is positioned at the supply position, and a pair of folding plates (117,118) movable toward and away from the strip of material support member (87,88) in a first direction across the strip of material for bending the end poritons of the strip of material (B) into an L-shape, and in a second direction perpendicular to the first direction for bending the L-shaped end portions of the strip of material (B) into a U-shape.

7 Claims, 12 Drawing Sheets

U3
U4
11c
101
102
103
104
105
106
107
107a
107b
108
108a
108b
78
82
83
83a
84
85
86
87
87a
87b
87c
88
88a
88b
88c
89
90
91
91a
91b
111
112
112a
113
114
115
116
117
117a
117b
118
118a
118b
B

APPARATUS FOR FOLDING A STRIP OF MATERIAL AND SUPPLYING THE SAME TO A SEWING MACHINE

BACKGROUND OF THE INVENTION

The present invention relates to an apparatus for folding a strip of material and supplying the same to a sewing machine, and more particularly to an apparatus for folding end portions of a strip of material and supplying the folded strip of material onto a base material placed on a sewing machine.

In the manufacture of various articles of clothing such as pants or jeans, a number of folded loops serving as belt loops must be stitched to a garment. In order to perform this operation automatically, an apparatus for forming and supplying folded loops to the garment is disposed adjacent the sewing machine. Such conventional apparatuses are disclosed in U.S. Pat. Nos. 4,114,544, 4,389,957, 4,502,399, 4,527,491, 4,561,365, 4,461,366 and 4,632,047.

In the disclosed apparatus, a pair of fork-shaped folding members are moved toward the end portions of a strip of material to be sewn until the fabric piece is inserted in the recesses of the folding members. Then, the folding members are angularly moved in predetermined directions to fold the end portions of the strip of material toward the reverse side of the strip of material, after which the strip of material is supplied onto a base material on the sewing machine by the folding members. The folded end portions of the strip of material supplied onto the base material are then pressed down against a feed plate of the sewing machine by a presser foot thereof. Thereafter, the folding members are pulled out of the strip of material, and the folded end portions of the strip of material are sewn to the base material on the sewing machine.

However, the folding members of the known structure are in the form of slender needle-like members, therefore, it has been required to prevent them from endangering the operator working at the sewing machine.

Further, since the tip ends of the folding members are weak in mechanical strength, they may be deformed when the folding members are replaced by other members in accordance with thickness variation of the strip of material, or the strip of material is pressed by the presser foot. The conventional folding members thus do not have sufficient durability.

On the other hand, other types of apparatus are disclosed in U.S. Pat. Nos. 4,287,842 and 4,385,571 besides the apparatus having fork-shaped folding members mentioned above. These apparatus comprise a template for supporting an intermediate portion of strip of material (belt loop). a pair of parallel spaced rods provided above the template, and C-shaped plates mounted on the forward end of each of the rods. With this structure, the C-shaped plates are rotated in opposite directions in which free ends of C-shaped plates are moved toward each other, thereby folding both end portions of the strip of material around the template. After the folding operation of the strip of material, the strip of material is supplied onto a base material on a feed plate below a presser foot of the sewing machine while holding the strip of material by the C-shaped plates and the template. The presser foot is lowered to press the strip of material supplied onto the base material against the feed plate, whereupon the C shaped plates are rotated in opposite directions in which the free ends of C-shaped plates are moved away from each other, and the C-shaped plates and the template are simultaneously moved away from the presser foot. Thus, the strip of material is transferred to the sewing machine, the sewing operation to stitch the strip of material to the base material is started. According to this apparatus using C-shaped plates, it is possible to overcome drawbacks of apparatus using the fork-shaped folding members since the weak fork-shaped folding members can be eliminated.

However, since the C-shaped plates are rotated in said opposite directions so as to retract from under position of said template while the strip of material is being pressed, it is difficult to lengthen sufficiently the free end portions of said C-shaped plates. Therefore the strip of material cannot be folded stably in this conventional apparatus.

Further, there is known belt looper apparatus disclosed in U.S. Pat. No. 3,699,907. This apparatus comprises a strip of material feeding device for feeding a strip of material, a strip of material folding device for folding both end portions of the strip of material, and a transferring device for transferring the folded strip of material to the sewing machine. With this structure, the strip of material is held and supplied to the strip of material folding device by the strip of material feeding device, the strip of material folding device is operated to fold the end portions of the strip of material and is moved toward the sewing machine. Thereafter the transferring device clamps the strip of material held by the strip of material folding device positioned close to the sewing machine and transfers the strip of material released from the strip of material folding device to the gap between the presser foot and the feed plate.

According to this apparatus, the strip of material can be folded stably. However, this apparatus is disadvantageous in that the apparatus is complex in structure and highly costly, and needs much time for maintenance.

SUMMARY OF THE INVENTION

In view of the aforesaid drawbacks of the conventional apparatus, it is an object of the present invention to provide an apparatus for folding a strip of material and supplying the same to a sewing machine, which has high folding stability and high durability, and which has a simple structure with low assembling cost.

In order to achieve the foregoing and other objects, there is provided in accordance with the present invention an apparatus for folding a strip of material and supplying the same to a sewing machine, the apparatus comprising a movable base (78) movably supported on a support frame (4) disposed adjacent the sewing machine bed (121); a first actuating means (80) for reciprocally moving the movable base (78) between its standby position and its supply position close to the sewing machine bed (121); a strip of material support member (87,88) mounted on the movable base (78) for receiving and supporting the strip of material (B) supplied when the movable base (78) is positioned at the standby position, and for transferring the strip of material (B) to the sewing machine bed (121) when the movable base (78) is positioned at the supply position, the strip of material supporting member (87,88) having opposite ends defining a length therebetween which is smaller than a length of the strip of material (B); a second actuating means (83) for reciprocally moving the strip of material support member (87,88) with respect to the movable base (78) for providing an advanced position and a retracted position when the movable base (78) is positioned at the supply position, the strip of material (B) being inserted into the gap in the supporting position of the strip of material support member (87,88) for placing the strip of material (B) onto the base material (C), and the strip of material (B) being transferred onto the base material (C) in the retracted position of the strip of material support member (87,88); a pair of folding plates (117,118) mounted on the movable base (78) and disposed adjacent the opposite ends of the strip of material support member (87,88) positioned in the supporting position; a third actuating means (114,115,116) for moving the pair of folding plates (117,118) toward and away from the strip of material support member (87,88) in a first direction across the strip of material for bending the end portions of the strip of material (B) into L-shape, and in a second direction perpendicular to the first direction for bending the L shaped end portions of the strip of material B) into U-shape, so that the end portions of the strip of material (B) are foldedly positioned below the strip of material support member (87,88).

With the present invention, when the movable base is positioned at the standby position and the strip of material support member is positioned at the advanced position, the strip of material is received by the strip of material support member. Upon movement of the pair of folding plates toward and away from the strip of material support member in first and second directions, the end portions of the strip of material are folded beneath the strip of material support member. Then, when the movable base is moved to the supplying position, the strip of material together with the strip of material support member is inserted into the gap between the presser member and the sewing machine bed. After the strip of material and the strip of material support member are pressed against the sewing machine bed by the press member, the strip of material support member is moved into the retracted position, and then the folding plates are moved and spaced from the sewing machine bed. Finally, the movable base is moved to the standby position.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

In the drawings:

FIG. 7 (*b*) and 7(*c*) are enlarged fragmentary cross-sectional view of the positioning unit;

DETAILED DESCRIPTION OF THE PREFERRED EMBODIMENTS

An embodiment of the present invention will hereinafter be described in detail with reference to the drawings.

Major units of the embodiment will successively be described. (Supporting structure for each unit)

Figure 1:
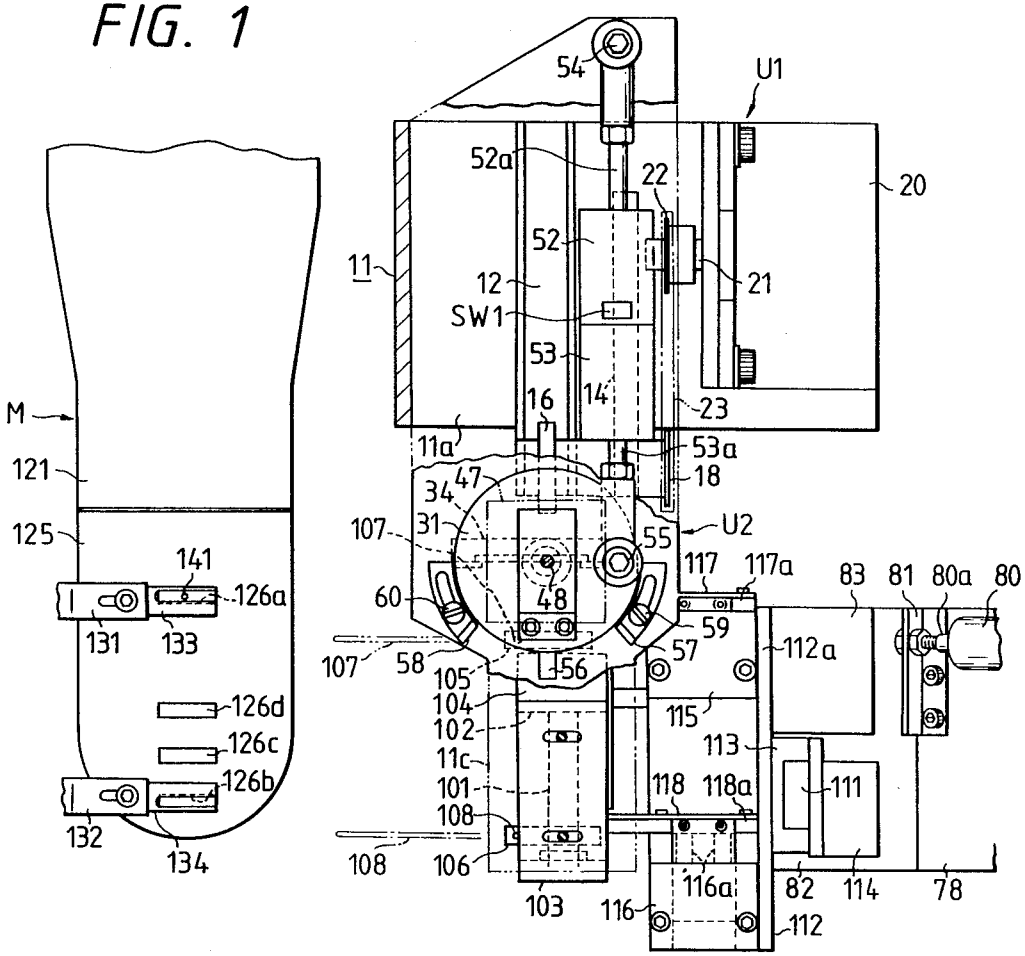
FIG. 1 is a plan view of an apparatus for folding a strip of material and supplying the same to a sewing machine according to an embodiment of the present invention.
Figure 2:
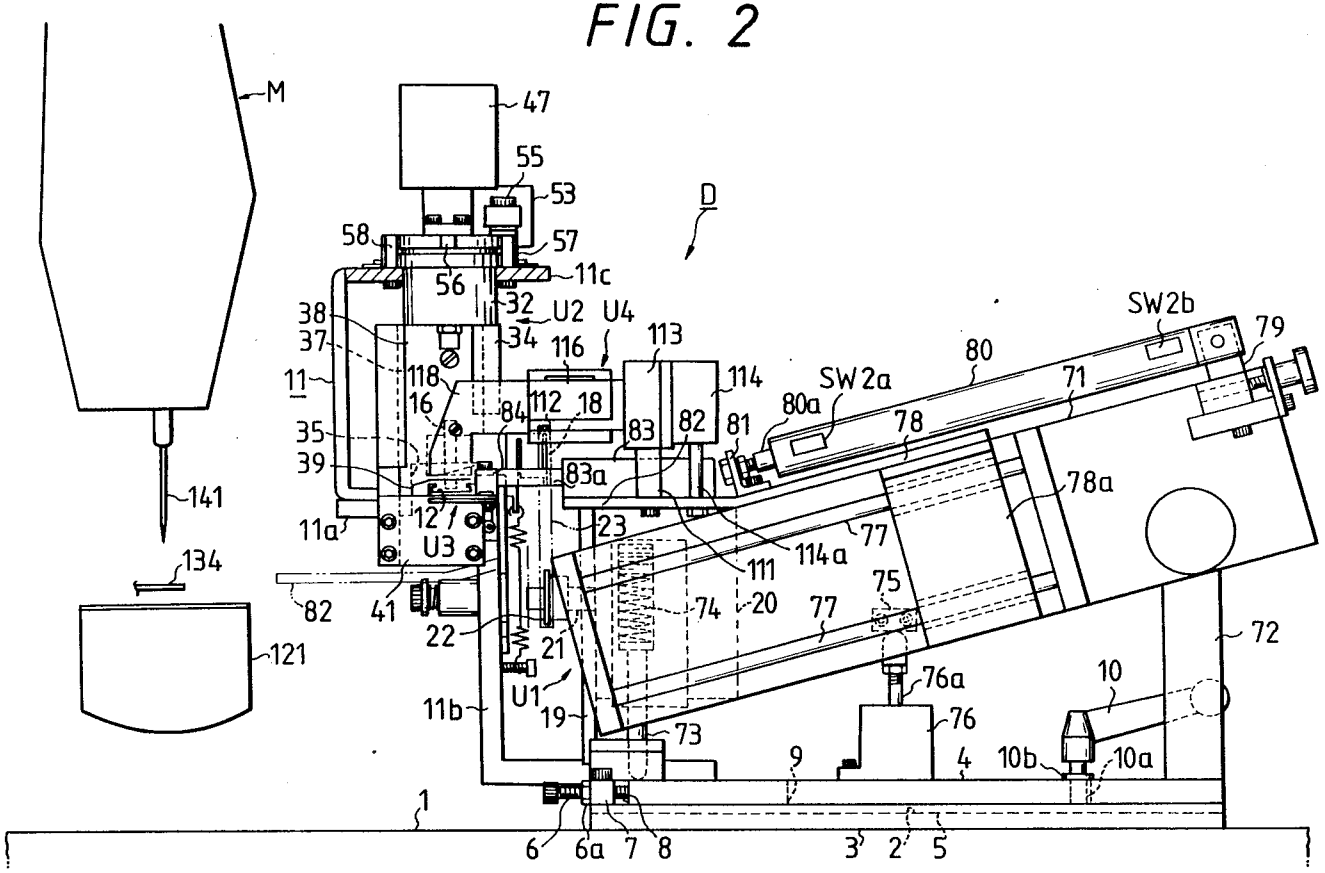
FIG. 2 is a front elevational view of the supplying device and the sewing machine.
Figure 3:
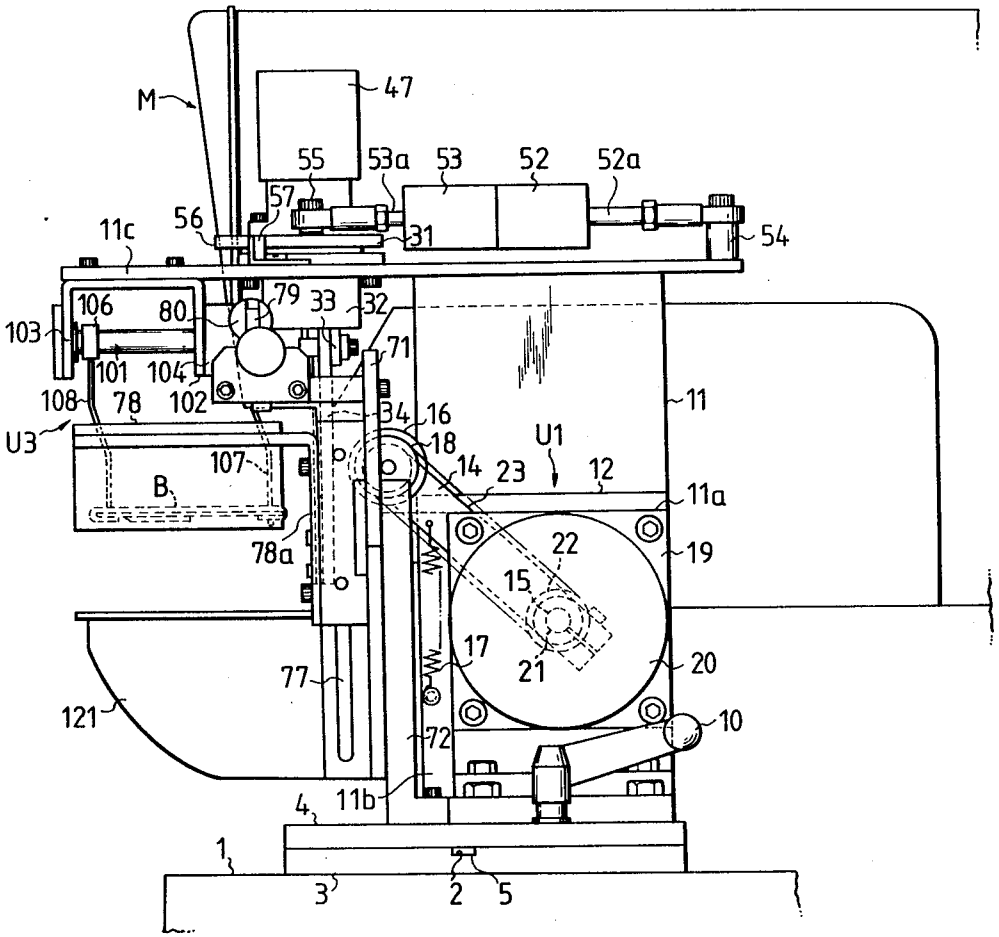
FIG. 3 is a righthand side elevational view of the supplying device and the sewing machine.

As shown in FIGS. 1 through 3, a cyclic sewing machine M for sewing a strip of material B which form a belt loop to a base material C such as a base material for pants is disposed above a lefthand side of a table 1. On the right-hand side of the table 1, there is disposed an apparatus for folding a strip of material and supplying the same to a sewing machine (hereinafter referred to as a "supplying device") D for cutting a tape-like fabric material (elongate material) T into a strip of material B with a prescribed length, folding the strip of material B at its end portions, and supplying the strip of material B into the sewing machine M. The supplying device D is movable toward and away from the sewing machine M.

More specifically, as illustrated in FIGS. 2 and 3, a base 3 having a laterally extending guide groove 2 defined therein is fixedly mounted on the table 1, and a support plate 4 for the supplying device D is laterally movably placed on the base 3. The support plate 4 has a guide ridge 5 on its reverse side which is slidably fitted in the guide groove 2. A stopper screw 6 with a lock nut 6*a* threaded thereon is supported on the lefthand end of a front portion of the base 3 by means of a support member 7, the stopper screw 6 being laterally adjustable, i.e., positionally adjustable toward and away from the sewing machine M. The support plate 4 has an engaging surface 8 on its lefthand side edge which can engages or disengage from the stopper screw 6. The support plate 4 further has a slot 9 extending parallel to the guide groove 2. A look lever 10 has a shank 10*a* extending through the slot 9 and rotatably threaded in the base 3. When the lock lever 10 is rotated to space a flange 10*b* thereof from the upper surface of the support plate 4, the support plate 4 is allowed to move laterally or toward or away from the sewing machine M. When the flange 10*b* is pressed against the upper surface of the support plate 4 by turning the lock lever 10, the support plate 4 is fixedly held in a desired position. When the support plate 4 is moved to bring the engaging surface 8 into engagement with the stopper screw 6, the supplying device D is kept in an operative position close to the sewing machine M.

(Material supply unit)

A supply unit U1 for feeding the tape-like fabric material (elongate material) T (FIG. 13) a predetermined length at a time from a material supply source not shown) will be described below.

As shown in FIGS. 1 through 3, an upstanding support bracket 11 is mounted on the rear portion of a lefthand side of the support plate 4. The support bracket 11 includes, at its intermediate portion, flat plate 11*a* having a material passage 12 defined by a guide rail which extends in a fore-and-aft direction (i e., a direction normal to the sheet of FIG. 2). The support bracket 11 has an upstanding wall 11*b* on which a roller support 14 is swingably supported at its proximal end by means of a support shaft 15. A féed roller 16 rotatably mounted on the distal end of the roller support 14 is angularly urged in a direction to engage the inner surface of a distal end of the material passage 12 by means of a spring 17. A sprocket wheel 18 which is rotatable with the feed roller 16 is also mounted on the distal end of the roller support 14.

A feed motor 20 is mounted on an upstanding support wall 19 disposed on the righthand side of the support bracket 11, and has an output shaft 21 supporting a sprocket wheel 22. A chain 23 is trained around the sprocket wheels 18 and 22. When the feed motor 20 is energized, the feed roller 16 is rotated in a material feeding direction through the output shaft 21, the sprocket wheel 22, the chain 23, and the sprocket wheel 18 for feeding the material T forwardly from the material supply source through the material passage 12. The material passage 12, the feed roller 16, and the feed motor 20 jointly constitute the supply unit U1.

(Material cutting unit)

A cutting unit U2 for cutting off the material T to a predetermined length will be described below.

As shown in FIGS. 2, 3, 5 and 6, a support sleeve 31 is rotatably supported on an upper flat plate 11*c* of the support bracket by means of a bearing 32, the support sleeve 31 is positioned above the front portion of the material passage 12. The support sleeve 31 includes a depending member 33 to which an upper end of a cutter blade holder 34 is attached. The cutter blade holder 34 has a hole 35 defined in an intermediate region thereof and confronting the material passage 12. A material rest 36 contiguous to a lower edge of the hole 35 is attached to the cutter blade holder 34.

The cutter blade holder 34 is formed with a guide recess 37 in which a movable cutter blade 38 is vertically movably disposed. The movable cutter blade 38 has a lower cutter edge 39 confronting the hole 35. The cutter blade 38 also has a guide finger 40 extending downwardly from the cutter edge 39. A fixed cutter blade 41 is secured to a lower portion of the cutter blade holder 34 in covering relation to the guide finger 40. Four connecting shanks 42 extend through the fixed cutter blade 41 and the cutter blade holder 34. Adjusting screws 43 are threaded on the distal ends of the respective connecting shanks 42. The fixed cutter blade 41 is pressed against the cutter blade holder 34 with the guide finger 40 sandwiched therebetween under the bias of springs 44 on the shanks 42 which is adjustable dependent on the position of the adjusting screws 43 on the shanks 42. The fixed cutter blade 41 has an upper cutter edge 45 for cooperating with the cutter edge 39 of the movable cutter blade 38 in cutting off the tape-like material T. A nozzle 46 for blowing off debris of the material T is inserted from below between the fixed cutter blade 41 and the cutter blade holder 34.

An air cylinder 47 is mounted on the upper surface of the support sleeve 31 for vertically moving the movable cutter blade 38, the air cylinder 47 has a piston rod 48 inserted in the support sleeve 31. The movable cutter blade 38 is connected to the lower end of the piston rod 48 by means of a connector 49 and a screw 50. In response to vertical movement of the piston rod 48, the cutter edge 39 of the movable cutter blade 38 is movable between a standby position in which it is spaced upwardly from the cutter edge 45 of the fixed cutter blade 41 to allow the material T to pass between the cutter edges 39, 45 and a cutting position in which the cutter edges 39, 15 coact with each other to cut off the material T. The cutter blade holder 34 has a slot 51 defined therein which has a length equal to the vertical stroke of the movable cutter blade 38, and the connector 49 and the screw 50 are disposed in the slot 51.

Figure 5:
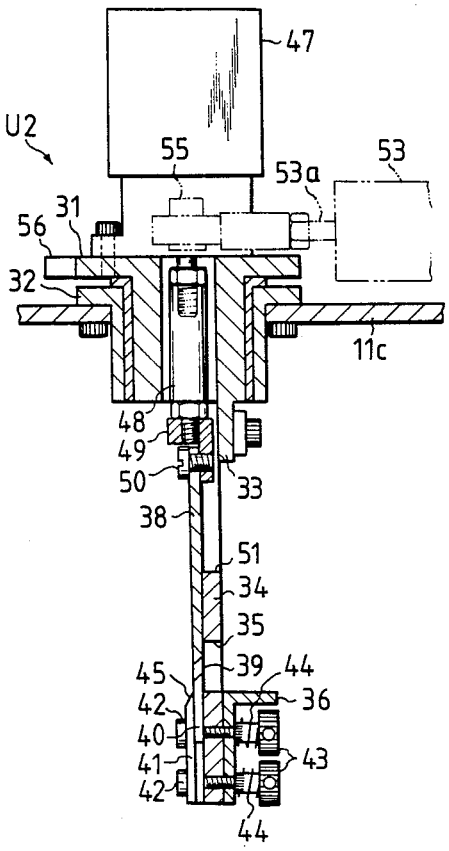
FIG. 5 is an enlarged fragmentary cross-sectional view of a cutting unit.

As shown in FIGS. 1, 3, and 5, a pair of rear and front air cylinders 52, 53 connected to each other are mounted on the upper flat plate 11*c* of the support bracket 11, the air cylinders 52, 53 have respective piston rods 52*a*, 53*a* movable in opposite directions. The piston rod 52*a* of the rear air cylinder 52 is angularly movably coupled to a support shaft 54 on the flat plate 11*c*. The piston rod 53*a* of the front air cylinder 53 is angularly movably coupled to a support shaft 55 on the support sleeve 31. Normally, the piston rod 52*a* of the rear air cylinder 52 is extended and the piston rod 53*a* of the front air cylinder 53 is retracted to place the cutter blade holder 34 in a neutral position in which it lies perpendicularly to the material passage 12.

The support sleeve 31 has a radial engaging arm 56 on its outer peripheral edge. When the cutter blade holder 34 is in the neutral position, the engaging arm 56 is positioned upwardly of the material passage 12. A pair of position limiting members or stoppers 57, 58 is attached to the flat plate 11*c*, one on each side of the engaging arm 56, by means of respective screws 59, 60. The position limiting members 57, 58 are angularly adjustable in position along an arc about the axis of rotation of the support sleeve 31. When the cutter blade holder 34 is positioned in the neutral position, the piston rod 52*a* of the rear air cylinder 52 is retracted to turn the support sleeve 31, the cutter blade holder 34, and the cutter edges 38, 41 in unison counter-clockwise in FIG. 1 until the engaging arm 56 is engaged by the position limiting member 57, whereupon the cutter edges 38, 41 are positioned in a material cutting plane Sa (see FIG. 12(*a*)) which is inclined with respect to a material feeding direction at an angle óa. By extending the piston rods 52*a*, 53*a* of the air cylinders 52, 53, the support sleeve 31, the cutter blade holder 34, and the cutter edges 38, 41 are turned in unison clockwise in FIG. 1 to bring the engaging arm 56 into engagement with the other position limiting member 58, thereby positioning the cutter edges 38, 41 in another material cutting plane Sb (see FIG. 12(*a*)) which is inclined with respect to the material feeding direction at an angle ób.

The support sleeve 31, the cutter blade holder 34, the movable cutter blade 38, the fixed cutter blade 41, the air cylinder 47, and the air cylinders 52, 53 jointly provide the cutting unit U2.

(Material positioning unit)

A positioning unit U3 for positioning the material T prior to the cutting off of the material T will be described below.

Figure 4:
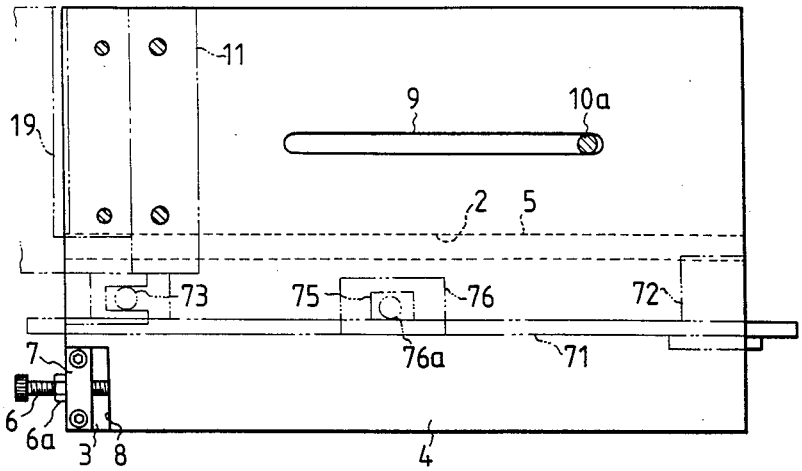
FIG. 4 is a plan view of a supporting structure for the supplying device.

As shown in FIGS. 2 through 4, a support member 71 is swingably supported at its proximal end on the support plate 4 by means of a support column 72. A damper rod 73 is vertically movably supported on the back of a distal end of the support member 71. The damper rod 73 is normally urged downwardly by a spring 74 to hold the lower end thereof against the upper surface of the support plate 4. With the damper rod 73 thus biased, the support member 71 is inclined from a lefthand lower position toward a righthand upper position (FIG. 2). A projection 75 is attached to the back of an intermediate portion of the support member 71, and an air cylinder 76 is mounted on the support plate 4 below the projection 75. When the air cylinder 76 is operated, a piston rod 76*a* thereof is extended into or retracted out of engagement with the projection 75 to cause the support member 71 to swing to move the distal end thereof vertically between an upper position shown in FIG. 2 and a lower position which is spaced downwardly from the upper position.

A pair of guide shafts 77 are mounted on the support member 71 parallel to the inclined longitudinal axis thereof. A movable base 78 is slidably mounted at its proximal end 78*a* on the guide shafts 77. A support arm 79 is positionally adjustably mounted on the righthand distal end of the support member 71. An air cylinder 80 has its proximal end pivotally connected to the support arm 79. The air cylinder 80 has a piston rod 80*a* joined to a joint 81 mounted on the upper surface of an intermediate region of the movable base 78. In response to extension and retraction of the piston rod 80*a*, the movable base 78 is reciprocally movable between a standby position in which the movable base 78 is spaced from the sewing machine M as indicated by the solid lines in FIG. 2 and a supply position in which the movable base 78 is positioned closely to the sewing machine M as indicated by the two-dot-and-dash lines in FIG. 2.

Figures 7A, 7B, 7C:
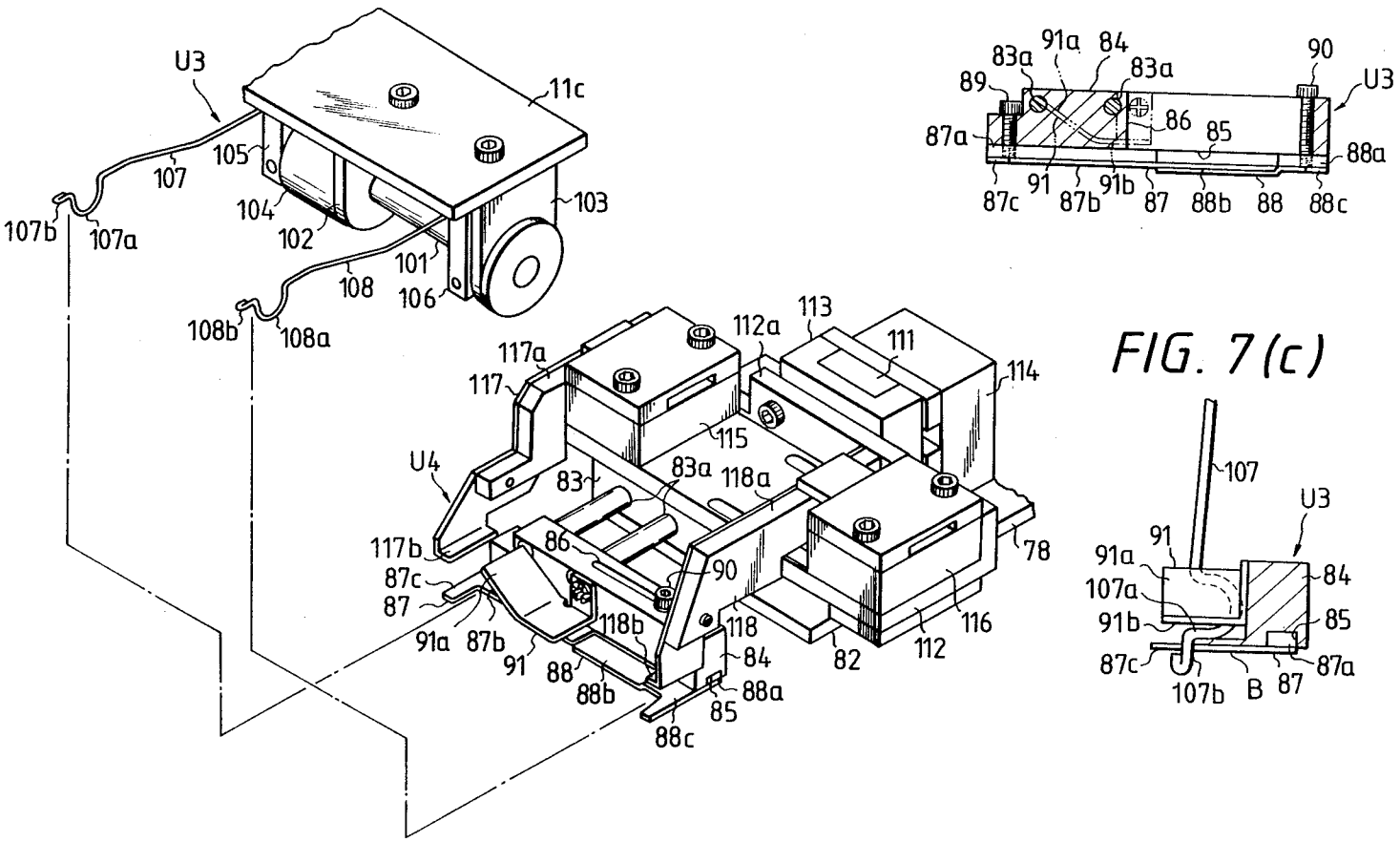
FIG. 7(*a*) is a perspective view of a positioning unit and a fold unit.

As shown in FIGS. 1, 2, and 7(*a*), the movable base 78 has, on its lefthand side, a substantially horizontal mount 82 supporting an air cylinder 83 on its upper surface. The air cylinder 83 has piston rods 83*a* with a bar-shaped limiting body 84 mounted thereon which extends along the material passage 12. As shown in FIGS. 7(*a*) through 7(*c*), the limiting body 84 has a guide groove 85 defined in a lower surface thereof and extending the entire length of the limiting body 84, and an oblong hole 86 defined in a front portion thereof and communicating with the guide groove 85.

A pair of rear and front support plates 87, 88 made of metal is mounted on the limiting body 84. The rear support plate 87 has a ridge 87*a* on its righthand upper surface, fitted in the guide groove 85, and is fixed to the limiting body 84 by means of a screw 89 threaded in the ridge 87*a*. The front support plate 88 has a ridge 88*a* on its righthand upper surface, slidably fitted in the guide groove 85, and is positionally adjustably attached to the limiting body 84 by means of a screw 90 extending through the oblong hole 86 and threaded in the ridge 88*a*. The front support plate 88 has a strip of material support 88*b* disposed below and near of a strip of material support 87*b* of the rear support plate 87. The rear and front support plates 87, 88 have projections 87*c*, 88*c* on their rear and front edges which extend to the left. With the screw 90 loosened, the front support plate 88 can be slid along the guide groove 85 to adjust the gap between the projections 87*c*, 88*c* dependent on the length of the strip of material B.

On the lefthand side surface of the limiting body 84, there is mounted a guide member 91 comprising a guide section 91*a* inclined from a rear upper position toward a front lower position, and a strip of material holder section 91*b* extending parallel to the support plates 87, 88. In response to extension and retraction of the piston rods 83*a*, the support plates 87, 88 are moved by the limiting body 84 between an advanced position in which the support plates 87, 88 receive the material T and a retracted position in which the support plates 87, 88 are retracted rightwardly from the advanced position. When the material T is fed along with the support plates 87, 88 in the advanced position, the material T is inserted between the strip of material holder section 91*b* and the support plates 87, 88, and supported on the support plates 87, 88 while being moved downwardly along the guide section 91*a*, even if the leading end of the material T is curled upwardly.

A rotatable shaft 101 extending in the fore-and-aft direction is reciprocally rotatably supported on the front end of the flat plate 11*c* of the support bracket 11 by means of a pair of shaft supports 102, 103, and is axially coupled to a rotary air cylinder 104. A pair of connectors 105, 106 are mounted on the rotatable shaft 101 so as to be positionally adjustable in the axial direction of the shaft 101. Bent positioning members 107, 108 made of a filamentary have proximal ends inserted in and fixed to the respective connectors 105, 106.

The positioning members 107, 108 have distal ends formed into respective arcuate pressers 107*a*, 108*a* and respective positioners 107*b*, 108*b* contiguous to the pressers 107*a*, 108*a*. Upon actuation of the rotary air cylinder 104, the rotatable shaft 101, the connectors 105, 106, and the positioning members 107; 108 are turned from a standby position shown in FIG. 7(*a*) in a counterclockwise direction to move the positioning members 107, 108 into a position inward of the projections 87*c*, 88*c* of the support plates 87. 88. When the positioning members 107, 108 are thus moved, the positioners 107*b*, 108*b* engage a side edge of the material T to move the material T toward the limiting body 84, and the pressers 107*a*, 108*a* press the material T against the support plates 87, 88.

The limiting body 84, the support plates 87, 88, and the positioning members 107, 108 jointly serve as the positioning unit U3.

(Folding unit)

A folding unit U4 for folding the end portions of the strip of material B which is cut from the material T will be described below.

As illustrated in FIGS. 1, 2, and 7(*a*), a support base 112 is vertically movably supported on a support column 111 mounted upwardly on the mount portion 82 of the movable base 78 by means of a frame 113 mounted on a righthand upstanding wall 112*a* of the support base 112. An air cylinder 114 is mounted on the frame 113 and has a piston rod 114*a* coupled to the mount portion 82 of the movable base 78.

A front air cylinder 115 is fixed to the rear upper surface of the support base 112, and a rear air cylinder 116 is mounted on a front upper surface of the support base 112, the air cylinder 116 being positionally adjustable in the material feeding direction. The air cylinders 115, 16 have piston rods (only piston rods 116*a* are shown in FIG. 1) connected at their distal ends to thick wall portions 117*a*, 118*a* of folding plates 117, 118 of metal which have respective confronting folders 117*b*, 118*b* on their distal ends. In response to operation of the air cylinder 114, the support base 112, the air cylinders 115, 116, and the folding plates 117, 118 are vertically moved in unison across the support plates 87, 88. In each of upper and lower positions in which the support base 112, the air cylinders 115, 116, and the folding plates 117, 118 are positioned, when the piston rods of the rear air cylinder 115 are retracted and the piston rods 116*a* of the front air cylinder 116 are extended, the folding plates 117, 118 are moved toward each other until the folders 117*b*, 118*b* are positioned inwardly of side edges of the support plates 87, 88. When the piston rods of the rear air cylinder 115 are expended and the piston rods 116*a* of the front air cylinder 116 are retracted, the folding plates 117, 118 are moved away from each other until the folders 117*b*, 118*b* are positioned outwardly of the side edges of the support plates 87, 88.

(Sewing machine)

The sewing machine M will be described with reference to FIGS. 8 and 9.

The sewing machine M has a bed 121 on which there is disposed a feed base 122 that is movable in x and y directions by a feeding unit (not shown). A movable rail 123 extending in the fore-and aft direction (vertically in FIG. 8 and horizontally in FIG. 9) is movably supported on the feed base 122 along a guide groove 124. A feed plate 125 for placing the base material C (FIG. 11) thereon is fixed to the front end of the movable rail 123 through an upstanding wall hole 126*a* defined therein and three front needle holes 126*b*, 126*c*, 126*d* defined therein at spaced intervals.

A presser foot support 127 is fixed at its proximal end to the upper surface of the movable rail 123 by a pair of screws 128, the presser foot support 127 has a guide groove 127*a* defined in a lefthand side surface thereof. An adjusting plate 129 having an adjusting groove 129*a* extending in the fore-end-aft direction is positionally adjustably disposed in the guide groove 127*a*. The adjusting plate 129 is fixed in a certain adjusted position by means of a pair of screws 130 extending through the adjusting groove 129*a* and threaded in the presser foot support 127.

A pair of substantially L-shaped presser members 131, 132 are vertically movably supported on the front end surface of the presser foot support 127 and a support block 129*b* on the front end of the adjusting plate 129, respectively, through plate-like attachments 131*a*, 132*a*, Rear and front bifurcated presser feet 133, 134 which project to the right are replaceably and positionally adjustably mounted on the lower ends of the presser members 131, 132 by means of screws 133*a*, 134*a* extending through slots 131*b*, 132*b* defined respectively in the presser members 131, 132. By adjusting the position of the adjusting plate 129, the front presser foot 134 can be aligned with one of the front needle holes 126*b*, 126*c*, 126*d*.

Air cylinders 135, 136 for vertically moving the presser feet 133, 134 are mounted on the front end surface of the presser foot support 127 and the support block 129*b*. The air cylinders 135, 136 have respective piston rods 135*a*, 136*a* coupled to the lower ends of the presser members 131, 132. When the piston rods 135*a*, 136*a* are extended or retracted, the presser members 131, 132 and the presser feet 133, 134 are vertically moved.

An air cylinder 137 is coupled at its proximal end to the feed base 122 for moving the presser feet back and forth, and has a piston rod 137*a* joined at its distal end to the lower surface of the front end of the presser foot support 127 through a connector 138. A substantially L-shaped stopper 139 is affixed at its proximal end to an outer side surface of the adjusting plate 129, and has a through hole 140 defined in a distal engaging portion 139*a* thereof with the piston rod 137*a* passing through the hole 140. The air cylinder 137 has on its front end a limiting member 137*b* which can engage the engaging portion 139*a* of the stopper 139.

Figure 8:
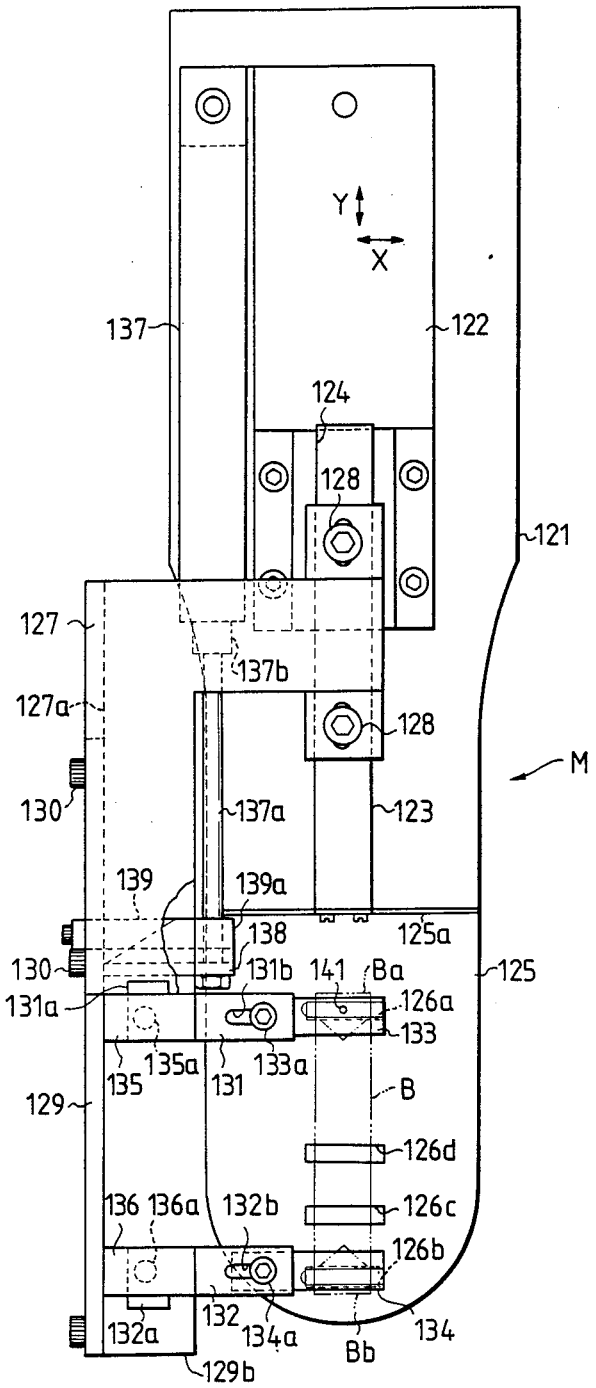
FIG. 8 is an enlarged plan view of the sewing machine.

As shown in FIG. 8, when the piston rod 137*a* is projected, the presser foot support 127, the adjusting plate 129, the movable rail 123, and the feed plate 125 are moved in unison into a front position in which the presser foot 133 on the rear presser member 131 and the rear needle hole 126*a* in the feed plate 125 are located in the path of vertical movement of a sewing needle 141. When the piston rod 137*a* is retracted while the front presser foot 134 is being held in confronting relation to any one of the front needle holes 126*b* through 126*d*, the engaging portion 139*a* of the stopper 139 is engaged by the limiting member 137*b*, and the presser foot support 127 and the members coupled thereto are held in a rear position in which the front presser foot 134 end the confronting one of the needle holes 126*b* through 126*d* are placed in the path of vertical movement of the sewing needle 141.

(Control unit)

A control unit for controlling the sewing machine M and the units U1 through U4 will be described below.

Figure 13:
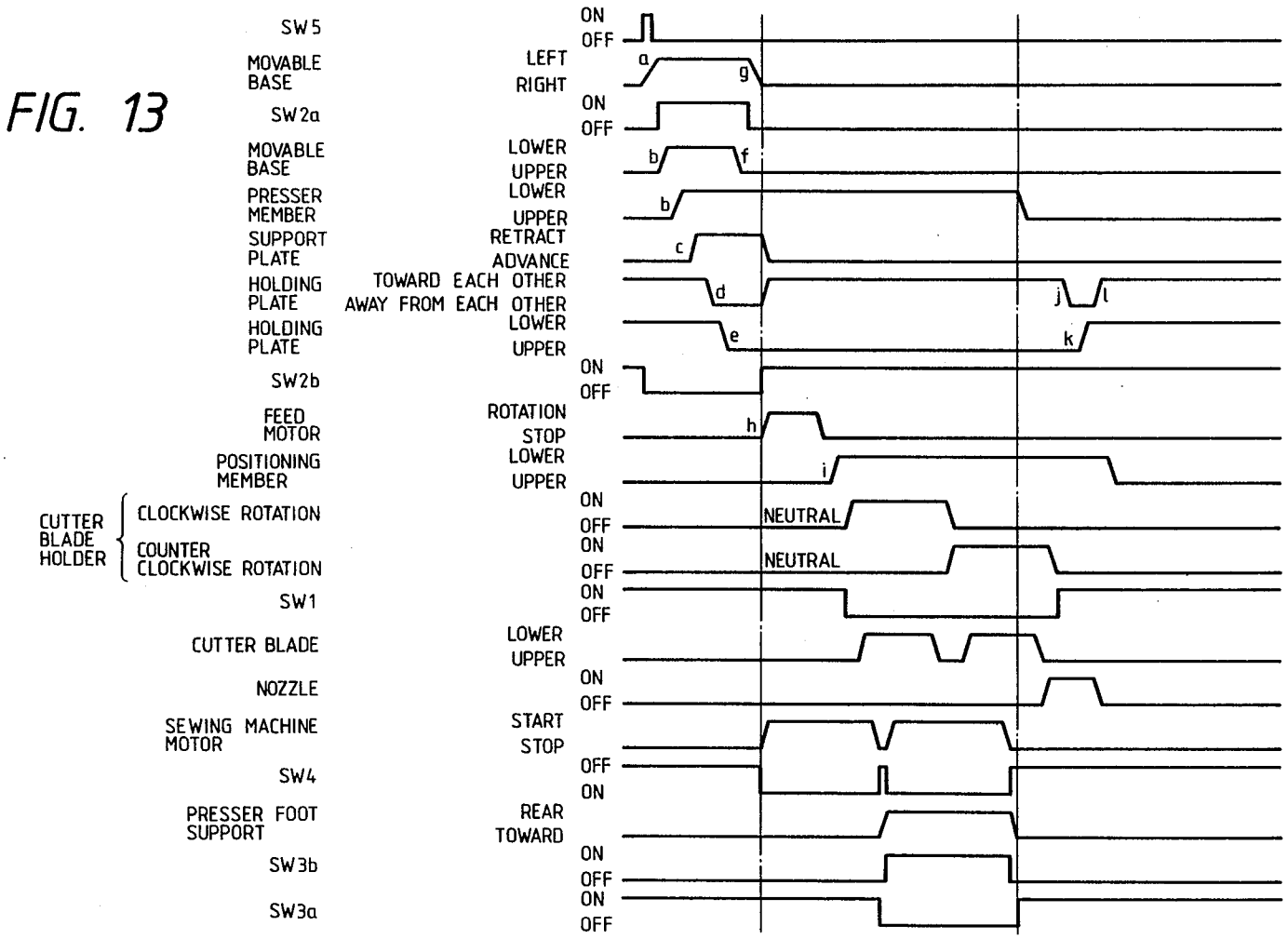
FIG. 13 is a timing chart of signals and operation of various components.

As shown in FIG. 1, the air cylinder 52 supports thereon a cutting position detector switch SW1 for detecting a portion of the piston rods 52*a*, 53*a* of the air cylinders 52, 53 to detect the position where the cutter blade holder 34 is located. The cutting position detector switch SW1 produces an output signal as shown in FIG. 13. As shown in FIG. 2, the air cylinder 80 supports thereon a pair of laterally spaced movable base detector switches SW2*a*, SW2*b* for detecting an inner end of the piston rod 80*a* to detect the position of the movable base 78. The switches SW2*a*, SW2*b* produce output signals as shown in FIG. 13. As shown in FIG. 9, the air cylinder 137 supports thereon a pair of front and rear presser foot detector switches SW3*a*, SW3*b* for detecting an inner end of the piston rod 137*a* to detect the position of the presser foot holder 127. The switches SW3*a*, SW3*b* produce output signals as illustrated in FIG. 13.

Figure 10:
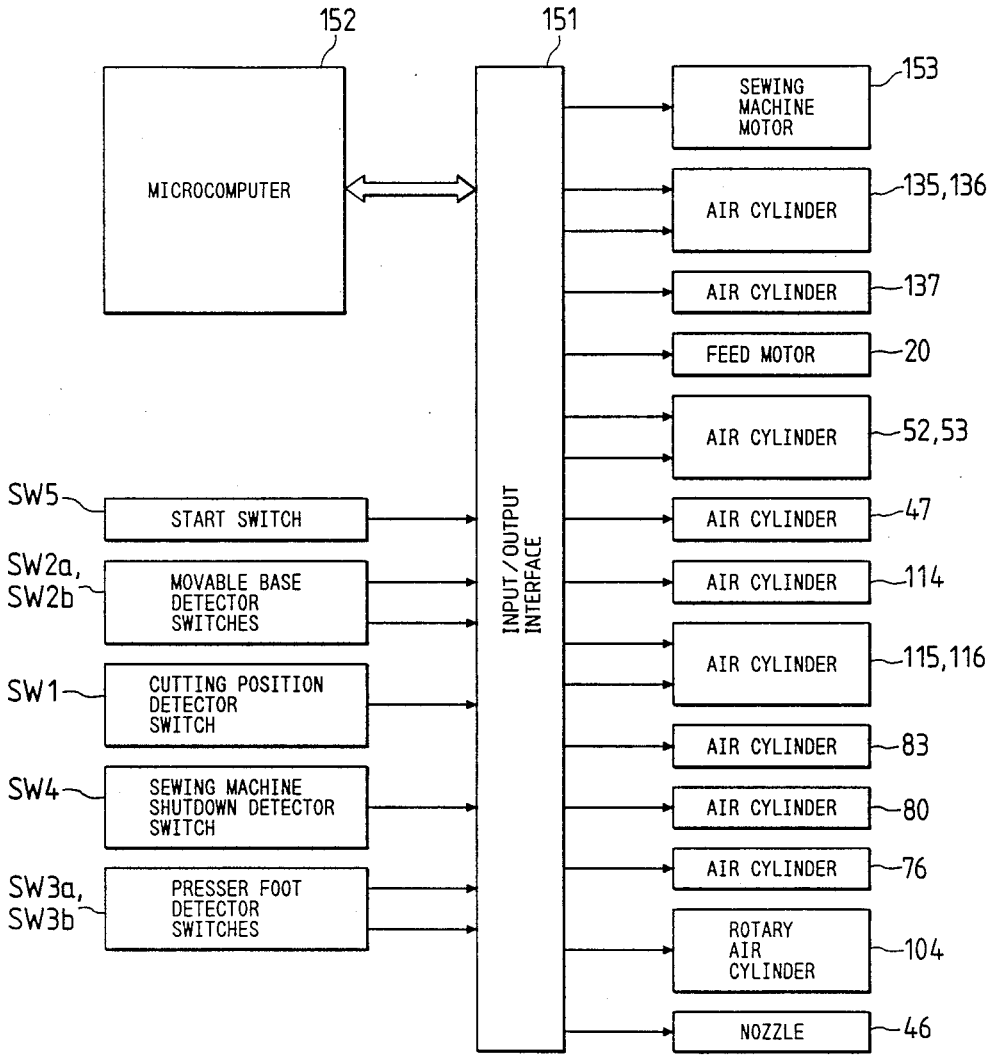
FIG. 10 is a block diagram of a control unit.

The sewing machine M has a sewing machine shutdown detector switch SW4 (see FIG. 10) for generating an output signal as shown in FIG. 13 when the sewing machine M is shut off. The output signals from the detector switches SW1, SW2*a*, SW2*b*, SW3*a*, SW3*b*, SW4, and a start signal (see FIG. 13) produced when a start switch SW5 (see FIG. 12) is operated are applied through an input/output interface 151 to a microcomputer 152, as shown in FIG. 10.

In response to the signals from the switches and according to a predetermined control program, the microcomputer 152 controls operation of a motor 153 (FIG. 10) of the sewing machine M, the fe-d motor 20, the air cylinders 135, 136, 137, 52, 53, 47, 114, 115, 116, 83, 80, 76, 104, and the air nozzle 46.

Operation of the supplying device D and the sewing machine M thus constructed will be described below also with reference to operation sequences shown in FIGS. 11(*a*) through 11(*l*) and FIGS. 12(*a*) through 12(*d*) and the timing chart of FIG. 13.

Figure 11:
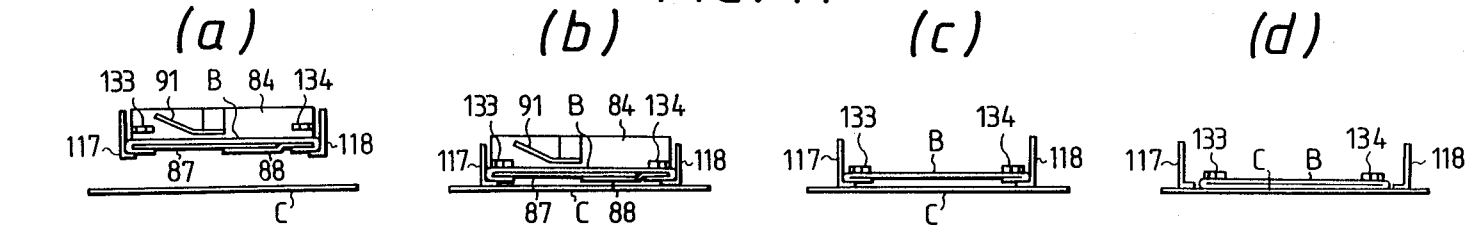
FIG. 11(*a*) through 11(*l*) are views showing an operation sequence of an apparatus according to an embodiment of the present invention.
Figure 12:
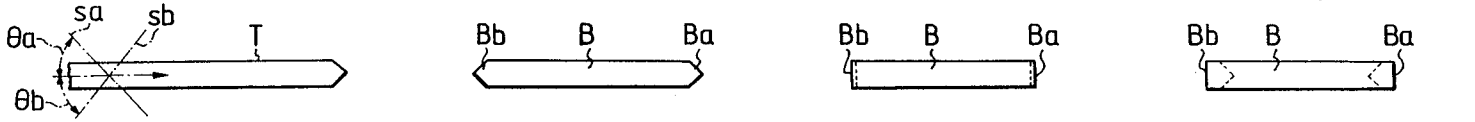
FIGS. 12(*a*) through 12(*d*) are views showing a sequence for processing a strip of material.

As shown in FIG. 11(*a*) the end portions of the strip of material B are folded over by the folding plates 117, 118, and the strip of material B is supported on the respective support plates 87, 88. The base material C is placed on the feed plate 125 of the sewing machine M. With a gap formed between the base material C and the presser feet 133, 134 of the presser members 131, 132, a start signal is applied from the start switch SW5 to the microcomputer 152 which then operates the air cylinder 80 (FIG. 2) to move the movable base 78 from the solid-line standby position to the two-dot-and-dash-line supply position. The strip of material B together with the support plates 87, 88 and the folding plates 117, 118 are inserted between the presser feet 133, 134 and the base material C. The alphabetical letters in FIG. 13 correspond respectively to the FIGS. 11(*a*) through 11(*l*).

After it has been confirmed that the movable base 78 has reached the supply position based on the signal from the movable base detector switch SW2*a*, the air cylinder 76 of FIG. 2 is actuated to swing the movable base 78 downwardly to place the strip of material B, the support plates 87, 88, and the folding plates 117, 118 on the base material C, as shown in FIG. 11(*b*). Then, the air cylinders 135, 136 of FIG. 9 are operated to lower the presser members 131, 132 to cause the presser feet 133. 134 to press the strip of material B, the support plates 87, 88, and the folding plates 117, 118 down against the base material C as shown in FIG. 11(*b*).

The air cylinder 83 shown in FIG. 7(*a*) is thereafter operated to pull the limiting body 84 and the support plates 87, 88 to the right (in a direction normal to the sheet of FIGS. 11(*a*) through 11(*l*)) from between the presser feet 133, 134 and the folding plates 117, 118, to space the limiting body 84 and the support plates 87, 88 to the right away from the presser feet 133, 134, as shown in FIG. 11(*c*).

Subsequently, the air cylinders 115, 116 shown in FIG. 7(*a*) are actuated to move the folding plates 117, 118 in the fore-and-aft directions away from the strip of material B and the presser feet 133, 134, as illustrated in FIG. 11(*d*). Therefore, the strip of material B is now transferred onto the sewing machine M.

The air cylinder 114 of FIG. 7(*a*) is operated to lift the folding plates 117, 118 with respect to the support plates 87, 88 as shown in FIG. 11(*e*), after which the air cylinder 76 of FIG. 2 is operated to raise the movable base 78, as shown in FIG. 11(*f*). and hence the folding plates 117, 118 and the support plates 87, 88 therewith. Then, the air cylinder 80 of FIG. 2 is actuated to return the movable base 78 to the rightward standby position, thus displacing the folding plates 117, 118 away from the sewing machine M, whereupon the process of supplying the strip of material B to the sewing machine M is completed, as shown in FIG. 11(*g*).

Figure 9:
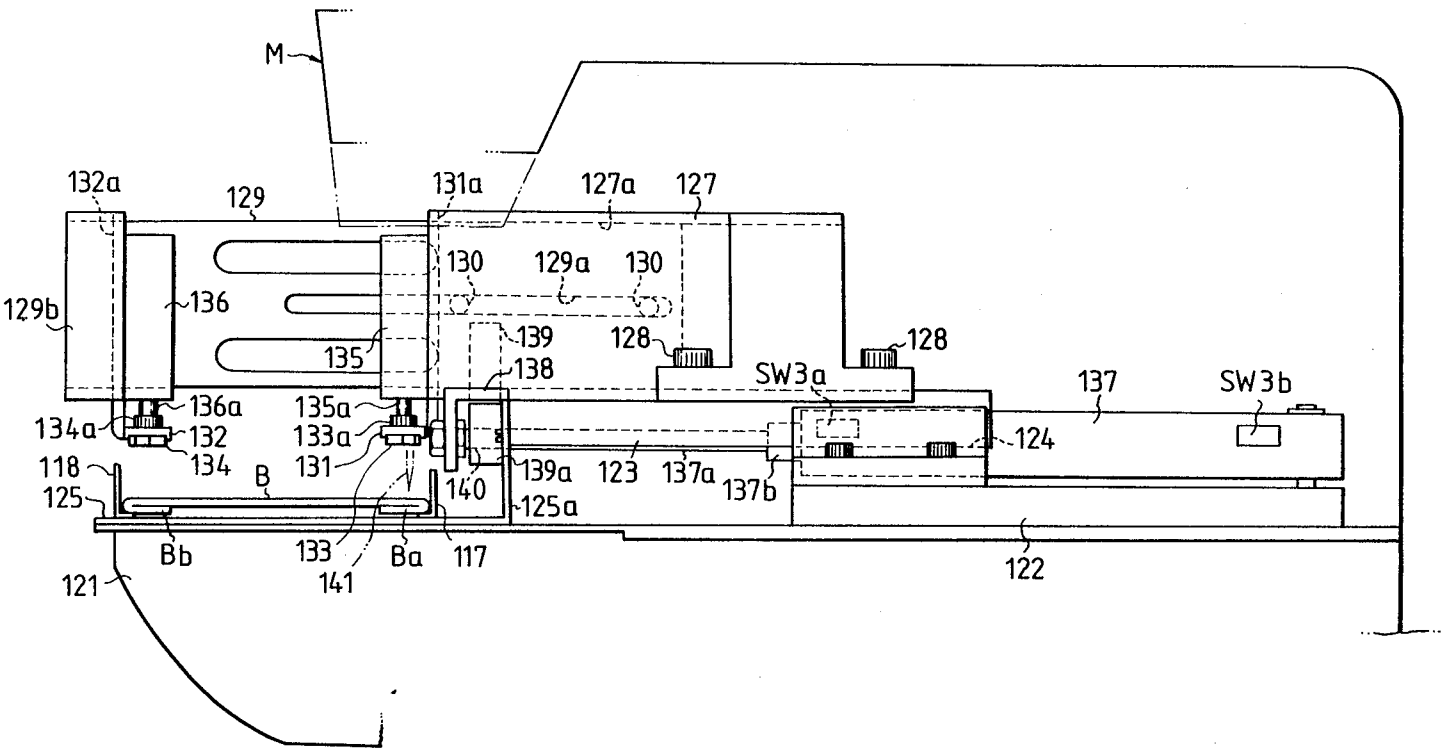
FIG. 9 is an enlarged righthand side elevational view of the sewing machine.

The present foot support 127 is disposed in the front position shown in FIGS. 8 and 9 to position the rear presser foot 133 and the rear needle hole 126*a* in alignment with the sewing needle 141. As the movable base 78 returns to the standby position under this condition, a signal is applied from the movable base detector switch SW2*b* to the microcomputer 152 which starts to energize the sewing machine motor 153 (FIG. 13). The feed plate 122 and other components of the sewing machine M are operated to feed the base material C and the strip of material B, while the sewing needle 141 is reciprocally vertically moved to carry out a sewing cycle for forming bar-tack stitches to sew a rear bent portion Ba of the strip of material B to the base material C.

When the rear bent portion Ba has been sewn to the base material C, a shutdown signal is applied from the sewing machine shutdown detector switch SW4 to the microcomputer 152, which then operates the air cylinder 137 of FIG. 8 to move the presser foot support 127 rearwardly. The strip of material B and the base material C are moved together rearwardly until a front bent portion Bb of the strip of material B is aligned with the sewing needle 141. Upon the rearward movement of the presser foot support 127, the signal from the presser foot detector switch SW3*a* is stopped, and a signal is applied from the presser foot detector switch SW3*b* to energize the sewing machine motor 153 again. A sewing cycle is effected again to sew the front bent portion Bb of the strip of material B to the base material C until the process of sewing the single strip of material B is finished. Then, the presser foot support 127 is returned to the front position again, and the presser members 131, 132 are moved back to the upper position.

Upon the returning movement of the movable base 78 to the standby position, a signal is supplied from the movable base detector switch SW2*b* of FIG. 2 to the microcomputer 152, which energizes the feed motor 20 to rotate the feed roller 16. The material T is then fed a predetermined length from the material supply source. After the leading end of the material T has passed between the movable cutter blade 38 and the fixed cutter blade 41 and between the guide member 91 and the support plates 87, 88, as shown in FIG. 11(*h*).

Then, the rotary air cylinder 104 of FIG. 7(*a*) is operated to turn the positioning members 107, 108 counterclockwise from the upper standby position of FIG. 7(*a*) until a side edge of the material T is brought into engagement with the limiting body 84 by the positioners 107*b*, 108*b* to position the material T across its width and also the lower surface of the material T is pressed against the support plates 87, 88 by the pressers 107*a*, 108*a* to position the material T across its thickness, as shown in FIGS. 11(*i*) and 7(*c*).

The piston rods 52*a*, 53*a* of the air cylinders 52, 53 shown in FIG. 1 are extended to turn the support sleeve 31 and the cutter blade holder 34 clockwise from the neutral position shown in FIG. 1. Then, the engaging arm 56 is engaged by the position limiting member 58 to position the cutter blades 38, 41 in the material cutting plane Sb (see FIG. 12(*a*)). The movable cutter blade 38 is now vertically moved by the air cylinder 47 (FIG. 1) to cut off the material T along the material cutting plane Sb. The pistons 52*a*, 53*a* of the air cylinders 52, 53 are retracted to turn the support sleeve 31 and the cutter blade holder 34 counterclockwise past the neutral position until the engaging arm 56 is engaged by the position limiting member 57. The cutter blades 38, 41 lie in the material cutting plane Sa, and the movable cutter blade 38 is vertically moved to out off the material T along the material cutting plane Sa, thus forming a strip of material B shown in FIG. 12(*b*).

Figure 6:
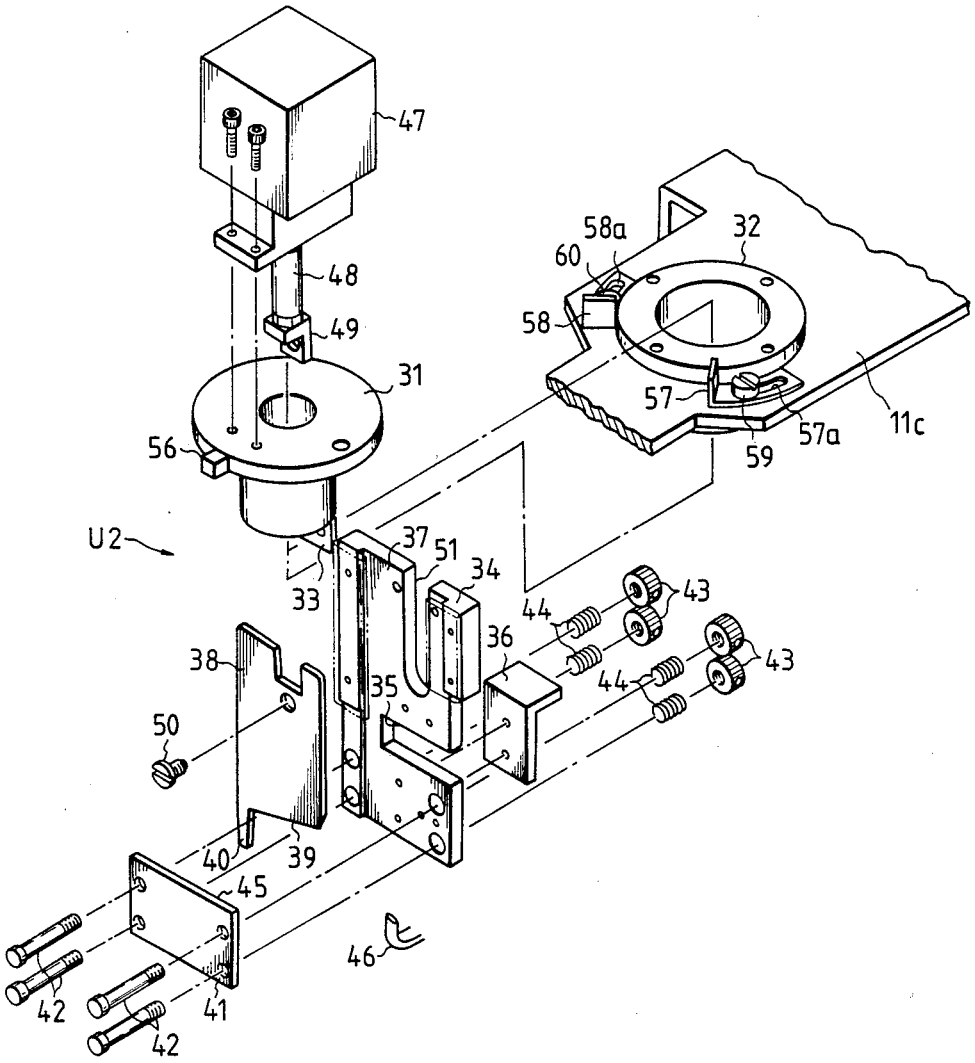
FIG. 6 is a fragmentary exploded perspective view of the cutting unit.

Immediately after the material T has been cut off twice in the above fashion, air is ejected from the nozzle 46 shown in FIG. 6 to remove any debris of the material T from between the cutter blades 38, 41. Then, as shown in FIG. 1, the cutter blade holder 34 is moved back to the neutral position. Upon elapse of a given period of time after a signal has been applied from the cutting position detector switch SW1, the folding plates 117, 118 are moved away from each other above the support plates 87, 88, as illustrated in FIG. 11(*j*). The folding plates 117, 118 are lowered below the support plates 87, 88 to engage and fold the end portions of the strip of material B into L-shape, as shown in FIGS 11(*k*) and 12(*c*).

Then, the folding plates 117, 118 are moved toward each other below the support plates 87, 88 to bend over the end portion of the strip of material B into a U-shape beneath the lower surfaces of the support plates 87, 88, as shown in FIGS. 11(*l*) and 12(*d*). The process of bending the strip of material B is now over, and a next cycle of sewing the strip of material B is initiated.

In the embodiment of the present invention, the strip of material B is supplied to the sewing machine M while the opposite ends of the strip of material B are being bent over by the folding plates 117, 118 and the support plates 87, 88. Therefore, the operator of the sewing machine is not endangered by the operating of the supplying device, and the strip of material B can be supplied directly along a straight path from the bending position to the sewing machine M. Accordingly, any time loss caused when feeding the strip of material B to the sewing machine M is reduced, and the structure required for feeding the strip of material B to the sewing machine M is simplified. Since the folding plates 117, 118 and the support plates 87, 88 are in the form of metal plates, they are not deformed and hence have increased durability when the strip of material B is pressed against them by the presser members 131, 132.

By inactivating the air cylinders 52, 53 to hold the cutter blades 38, 41 in the neutral position the material T can be cut off along a plane normal to the material feeding direction. Moreover, the angles óa, ób between the material cutting planes Sa, Sb and the material feeding direction can be varied as desired by adjusting the positions of the position limiting members or stoppers 57, 58.

According to the present invention, as described above, the members used to fold the end portions of the strip of material are of increased durability and can be employed with safety. The apparatus has high folding stability and a simple structure with low assembling cost.

What is claimed is:

1. An apparatus for folding a strip of material and supplying the same to a sewing machine, the sewing machine including a sewing needle (141), a sewing machine bed (121) for placing a base material (C), and a presser member (131,132) being relatively movable with respect to the sewing needle (141) in a horizontal direction, the presser member (131,132) being also vertically movable between an upper position for forming a gap relative to the sewing machine bed (121) and lower position for pressing the strip of material (B) supplied onto the base material (C) against the sewing machine bed (121), the apparatus comprising:

a movable base (78) movably supported on a support frame (4) disposed adjacent said sewing machine bed (121);

a first actuating means (80) for reciprocally moving said movable base (78) between its standby position and its supply position close to said sewing machine bed (121);

a strip of material support member (87,88) mounted on said movable base (78) for receiving and supporting said strip of material (B) supplied when said movable base (78) is positioned at said standby position, and for transferring said strip of material (B) to said sewing machine bed (121) when said movable base (78) is positioned at said supply position, said strip of material supporting member (87,88) having opposite ends defining a length therebetween which is smaller than a length of said strip of material (B);

a second actuating means (83) for reciprocally moving said strip of material support member (87,88) with respect to said movable base 78 for providing an advanced position and a retracted position when said movable base (78) is positioned at said supply position, said strip of material (B) being inserted into said gap in said advanced position of said strip of material support member (87,88) for placing the strip of material (B) onto said base material (C), and said strip of material (B) being transferred onto said base material (C) in said retracted position of said strip of material support member (87,88);

a pair of folding plates (117,118) mounted on said movable base (78) and disposed adjacent said opposite ends of said strip of material support member (87,88) positioned in said advanced position; and, a third actuating means (114,115,116) for moving said pair of folding plates (117,118) toward and away from said strip of material support member (87,88) in a first direction across said strip of material for bending said end portions of said strip of material (B) into L-shape, and in a second direction perpendicular to said first direction for bending said L shaped end portions of said strip of material (B) into U-shape, so that said end portions of said strip of material (B) are foldably positioned below said strip of material support member (87,88).

2. An apparatus as defined in claim 1, further comprising cutting means for cutting a base material into said strip of material (B) having said length.

3. An apparatus as defined in claim 2, further comprising feed means (16) for feeding said base material to said cutting means.

4. An apparatus as defined in claim 2, wherein said cutting means comprises a pair of cutter blades (38,41), a cutter blade holder (34) for holding said cutter blades (38,41), and cutter blade holder rotation means (52,53) connected to said cutter blade holder (34) for angularly rotating said cutter blade holder (34) to allow said cutter blades (38,41) to be positioned in a material cutting plane inclined with respect to a material feeding direction at a predetermined angle.

5. An apparatus as defined in claim 4, wherein said cutter blades (38,41) provide at least two inclined positions for chamfering rectangular corners of said strip of material (B) in accordance with the angular rotation of said cutter blade holder (34).

6. An apparatus as defined in claim 1, wherein said strip of material support member comprises two support plates (87,88) being movable toward and away from each other along a longitudinal direction of said strip of material (B) supplied thereon.

7. An apparatus as defined in claim 1, further comprising positioning members (107,108) which engage a side edge of said strip of material (B) to move said strip of material (B) in place on said strip of material support member (87,88) and press said strip of material (B) against said strip of material support member (87,88).

* * * * *